United States Patent [19]

Jesme et al.

[11] 4,159,767

[45] Jul. 3, 1979

[54] FOLDER-TANG ASSEMBLY APPARATUS

[75] Inventors: Philip O. Jesme, South St. Paul; John A. Calkins, Hastings, both of Minn.

[73] Assignee: The Smead Manufacturing Company, Hastings, Minn.

[21] Appl. No.: 813,653

[22] Filed: Jul. 7, 1977

[51] Int. Cl.[2] ..... B65D 85/54; B65D 27/26

[52] U.S. Cl. ..... 206/343; 206/820; 24/153

[58] Field of Search ..... 206/343, 338, 820; 229/78 A; 24/153 R, 129 B

[56] References Cited

U.S. PATENT DOCUMENTS

| | | | |
|---|---|---|---|
| 782,670 | 2/1905 | Leahy | 229/78 A |
| 1,523,494 | 1/1925 | Sibley | 206/820 |
| 2,132,693 | 10/1938 | Martin et al. | 24/153 R |
| 3,014,580 | 12/1961 | Brody et al. | 206/820 |

*Primary Examiner*—William T. Dixson, Jr.
*Attorney, Agent, or Firm*—Clayton R. Johnson

[57] ABSTRACT

For use in combination with a machine that has an endless conveyor for conveying a file folder to a tang assembly station and thence away therefrom, folder tang assembly apparatus that includes a frame, a feed assembly for indexingly feeding a plurality of webs having folded tangs nearly punched thereoutof, a stationary die plate, a stripper bar above the die plate, a pressure pad for each web reciprocally mounted in a die plate aperture to press the web against the stripper bar, tang punches reciprocally extended in the pressure pad for punching a tang out of a web, through a stripper bar aperture, and against a folder, a cinching device for each web to cinch the tang to the folder when the punches move the tang against the folder, a tang location quill carried by one of the tang punches for each web to properly locate the tang to be punched out of the web, a power operated lower die shoe for reciprocating the punches, and piston cylinders for moving the pressure pads to press the webs against the stripper plates. As carried by the web each tang is folded to have one prong overlay the other and a ring portion that is joined to one prong overlaying the ring portion that is joined to the other prong. The ring portions are integrally joined to tabs opposite the prongs.

11 Claims, 14 Drawing Figures

127
23
130
131

129
170
128
130b
135a
95a
11
18
92
130a
95
111
113
112
91
87
14
15
13
107
108
124
110
83
84
45b
25a
171
25
47b
45
10
171a
97
47a
42
109
43
45a
26
105
109a
23
44
46
57
30
30
24
54

53
88
92
90
89
91
87
30a

FOLDER-TANG ASSEMBLY APPARATUS

BACKGROUND OF THE INVENTION

A machine for assemblying tangs on file folders.

In the prior art it is old to provide a tang-file folder assembly machine wherein completely disconnected (completely punched out) tangs are positioned in a magazine to be fed therefrom and cinched to a file folder. However, there is a problem in filling the magazine and properly aligning the tangs in the magazine. In order to overcome problems such as the above, as well as others, this invention has been made.

SUMMARY OF THE INVENTION

Apparatus for cinching a tang to a file folder or the like that includes a feed assembly for indexingly advancing a web that has a folded tang nearly punched thereoutof, a stationary die plate to support the web, a stripper plate on the die plate and extending across the web, a cinching device mounted above the stripper plate, a reciprocally operated pressure pad to hold the web against the stripper plate, and power operated punch mechanism to punch the tang out of the web while it is held against the stripper plate and cooperative with the cinch device to cinch the punched out tang to the folder.

One of the objects of this invention is to provide new and novel apparatus for feeding tangs to a position to be cinched to a file folder or the like. Another object of this invention is to provide new and novel apparatus for completing the severing of a partially severed tang from a web and cinch the severed tang to a file folder or the like. A further object of the invention is to provide a new and novel web containing partially punched out tangs.

BRIEF DESCRIPTION OF THE DRAWINGS

FIG. 1 is a side view of the apparatus of this invention in a datum condition, the tang web feed structure being broken away;

FIG. 8 is a fragmentary top view of a tang web;

Figure 2:
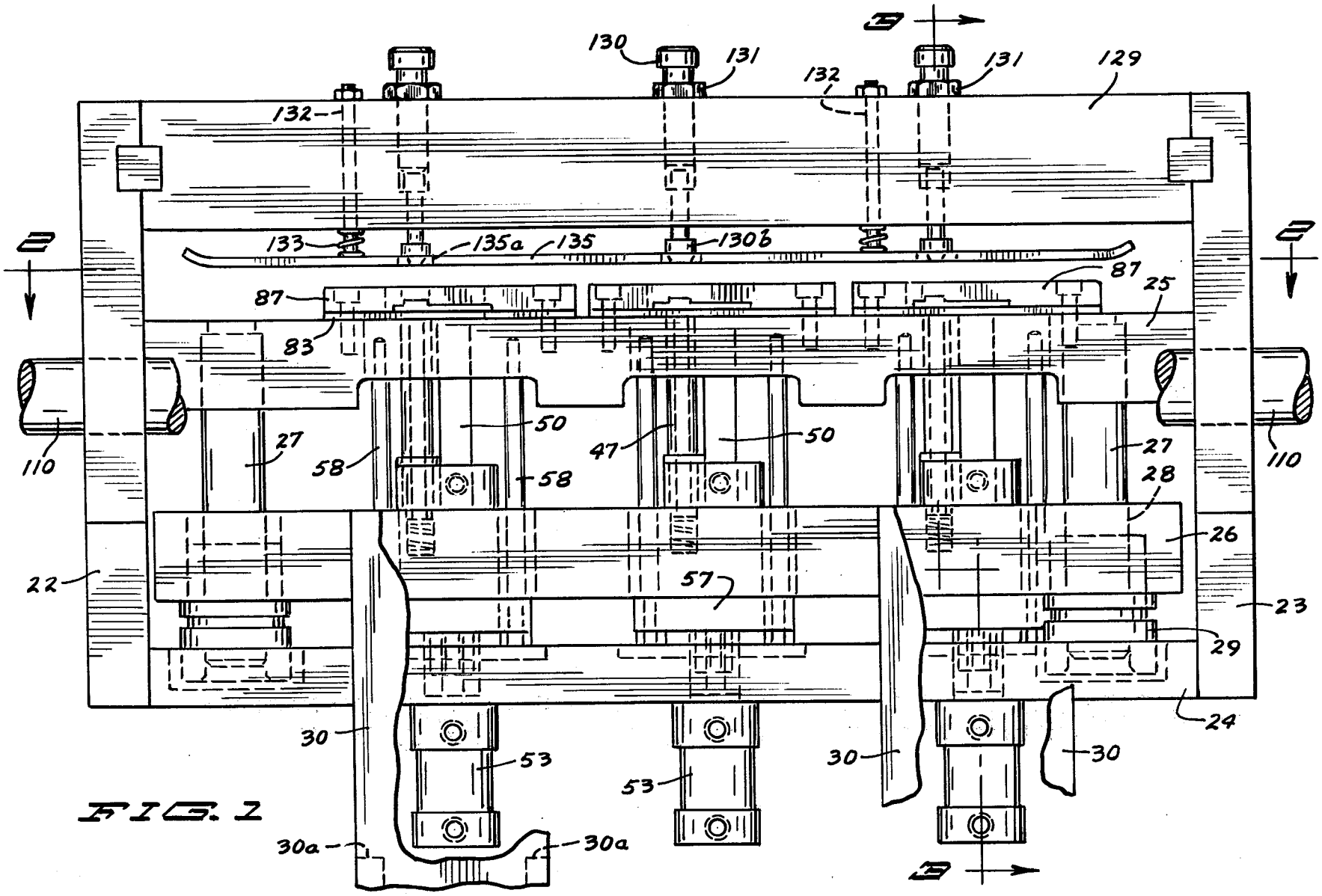
FIG. 2 is a horizontal cross sectional view generally taken along the line and in the direction of the arrow 2—2 of FIg. 1, said view showing portions of the structure of the machine for moving a file folder, and portions of the web feed assembly being broken away.
Figures 3, 12:
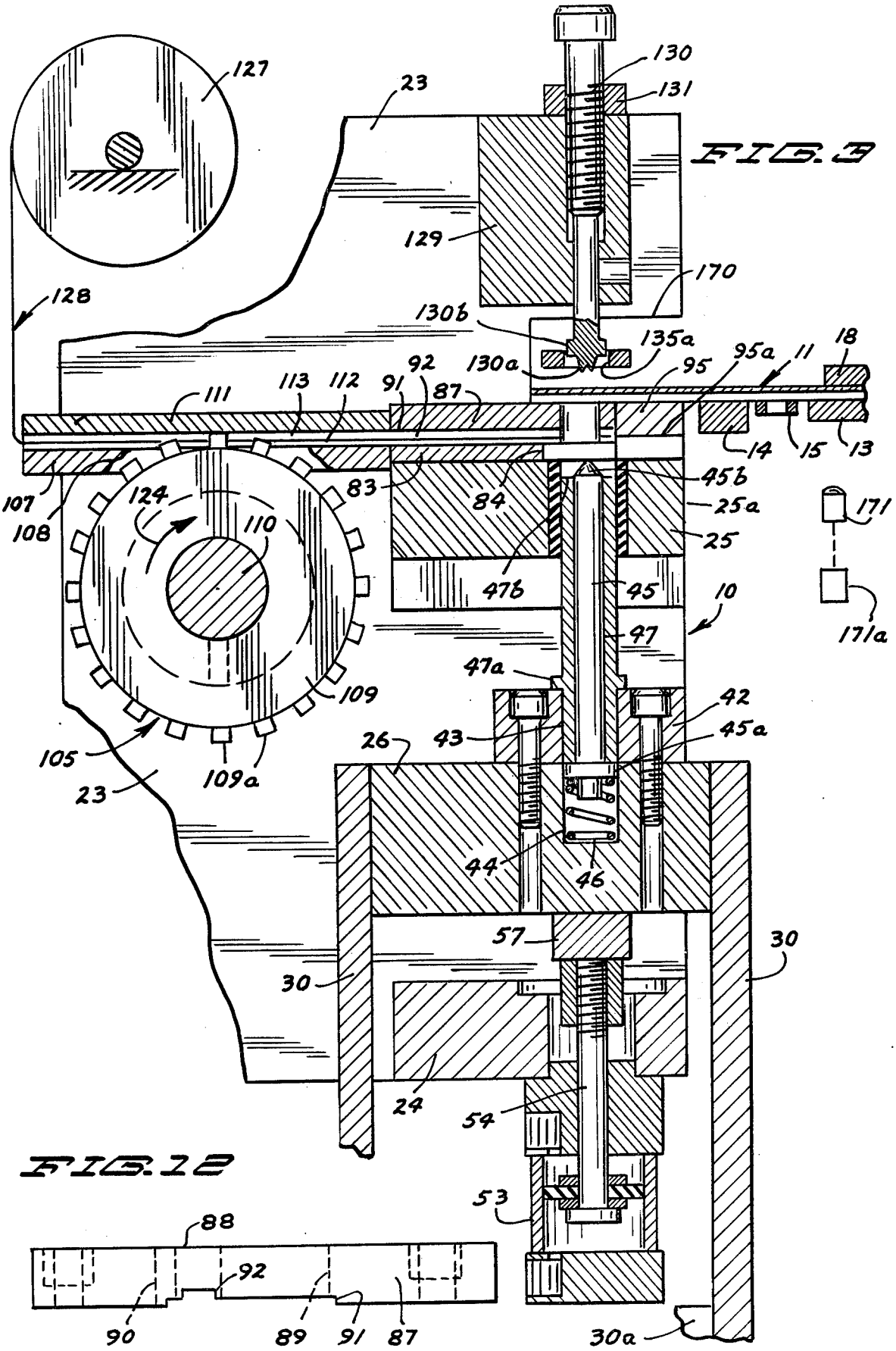
FIG. 3 is a transverse cross sectional view generally taken along the line and in the direction of the arrow 3—3 of FIG. 1.
FIG. 12 is a side view of the upper feed plate.

Referring now in particular to FIGS. 2 and 3, a file folder, generally designated 11, is longitudinally moved by a folder carrier machine, generally designated 12. The machine 12 includes a horizontal slide 13, a longitudinally elongated slide bar 14 on each side of the slide, and an endless link chain 15 on either transverse side of the slide 13 that along its upper runs has longitudinally spaced pairs of pushers 16 and 17 extending upwardly thereof. Each of the pushers 16 and 17 is of the same construction, the longitudinal spacing of the pushers 16 and 17 being substantially the same as the length of the file folder that is to have tangs cinched thereto by the apparatus of this invention, generally designated 10. The machine 12 includes a hold down bar 18 for retaining a folder in engagement with a slide 13 as the folder is moved therebetween by the pushers.

The apparatus 10 may be mounted on the frame of the machine 12 or on a separate frame, the apparatus 10 including frame end plates 22 and 23. A longitudinally elongated cylinder mounting plate 24 is attached to the lower ends of the end plates 22, 23 while a stationary die plate 25 is attached to the vertically intermediate portions of such end plates. Adjacent each end plate there is provided a vertical guide rod 27 that is mounted by plates 24 and 25, a lower die shoe 26 being mounted by the guide rods for reciprocal vertical movement relative thereto by being extended through the shoe apertures 28. Annular stops 29 are mounted on the guide rods to limit the downward movement of the die shoe toward the cylinder mounting plate.

In order to move the die shoe 26 in proper timed relationship to machine 12, clevis brackets 30 are pivotally attached to the die shoe at 31, such brackets being mounted by one ends of arms 32. The opposite ends of arms 32 are mounted by cams 34 that are eccentric to the driven shaft 33 of the machine 12. Thus as shaft 33 rotates, due to the cams being eccentric relative the axis rotation of the shaft, the arms will cause the die shoe to be vertically reciprocated.

Assuming that three tangs are to be cinched to each file folder, then the apparatus 10 is provided with three substantially identical sets of mechanism for feeding and punching out tangs to be cinched to the file folder. Each such set of mechanism includes a support block 42 that is bolted to the lower die shoe to extend thereabove, the support block having a vertical aperture 43 extending therethrough which opens directly to an aperture 44 in the cylinder mounting plate. Aperture 44 extends only partially through the plate 26 and has a coil spring 46 mounted therein that constantly resiliently urges a tang guide pin 45 in an upward direction. The upper end of spring 46 seats against an enlarged angular flange **45*a* of the pin which is of only a slightly smaller diameter than that of the diameter of the aperture 44. As may be noted in FIG. 3, the guide pin 45 extends a substantial distance vertically above flange 45*a* and remote therefrom has a frusto conical point 45*b*. Guide pin 45 is extended up through the central opening of an annular male punch 47, the punch 47 having an annular flange 47*a* that seats against the top surface of the block 42 and extends through aperture 43 to abut against flange 45***a* to limit the upward movement of the guide pin. When flange 45*a* abuts against the lower end of punch 47, the frusto conical point 45*b* extends to a higher elevation than the top angular edge 47*b* of the punch 47.

Figure 4:
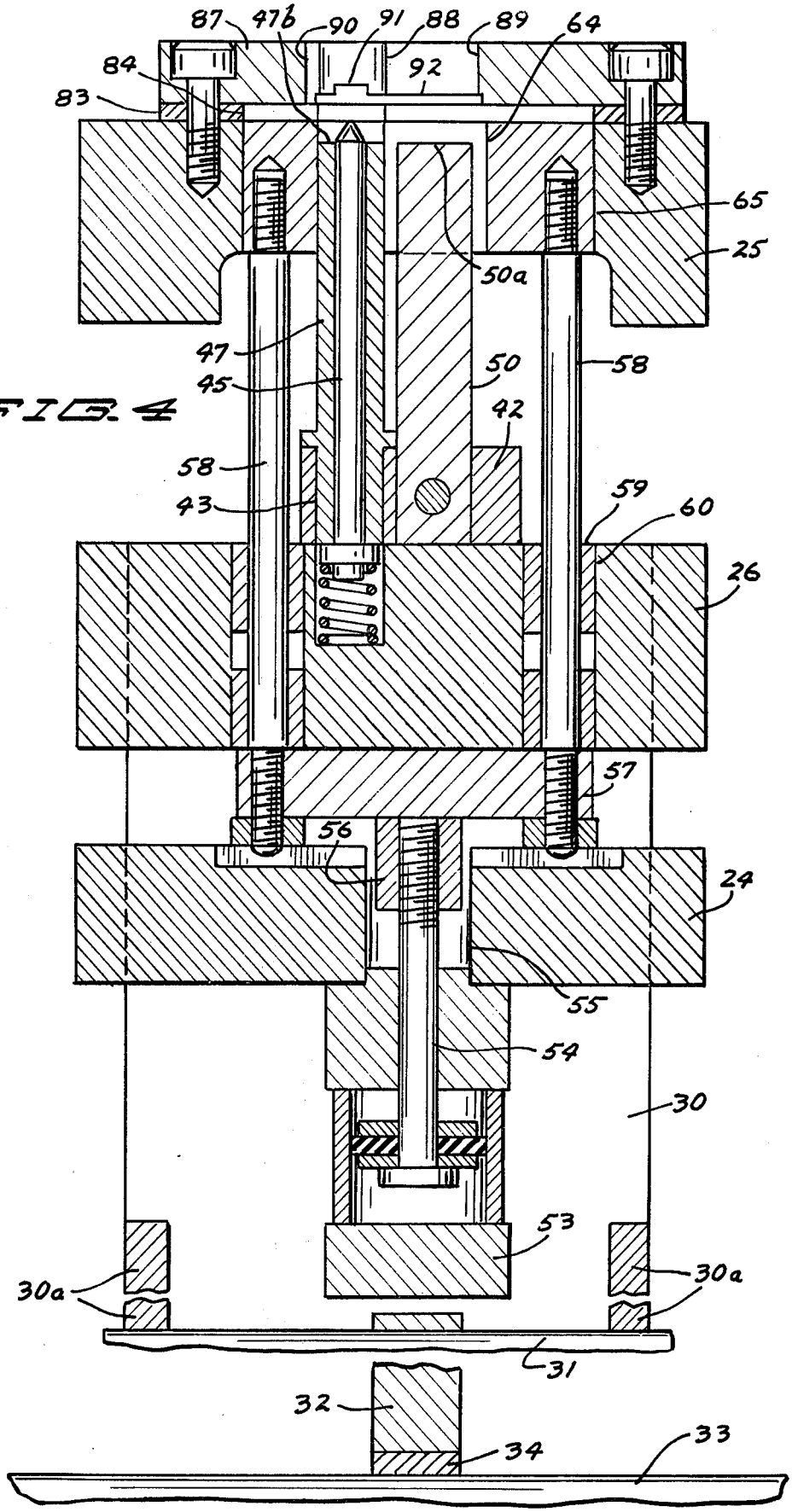
FIG. 4 is a fragmentary longitudinal view generally taken along the line and in the direction of the arrows 4—4 of FIG. 2, said view illustrating the pressure pad and tang punches in a datum condition.

Referring to FIG. 4, each block 42 has a slot in which a tang support plate punch 50 is mounted such that the lower edge of the punch abuts against the shoe 26 and the upper edge 50*a* is at substantially the same elevation as angular edge 47*b*. Punch 50 is rectangular in horizontal cross-section. Mounted by the cylinder mounting plate 24 in depending relationship thereto to be located vertically beneath the respective block 42 is a cylinder 53. The cylinder 53 has a piston rod 54 extended upwardly through an aperture 55 in plate 24 and at its upper end mounts a ram plug 56. The upper edge of the ram plug is movable relative to a rod end block 57 and in a position to be abuttable against the central portion thereof to move block 57 upwardly. The longitudinally opposite ends of the rod end block mount the lower ends of vertical guide pins 58 in fixed relationship thereto. The guide pins slidably extend through the slide bushings 59 that are mounted in apertures 60 of the lower die shoe. The upper ends of the guide pins are threadedly connected to the opposite end portions of a longitudinally elongated tang pressure pad, generally designated 64, that is vertically reciprocally mounted in a tang pressure pad aperture 65 provided in the stationary die plate 25.

Figure 6:
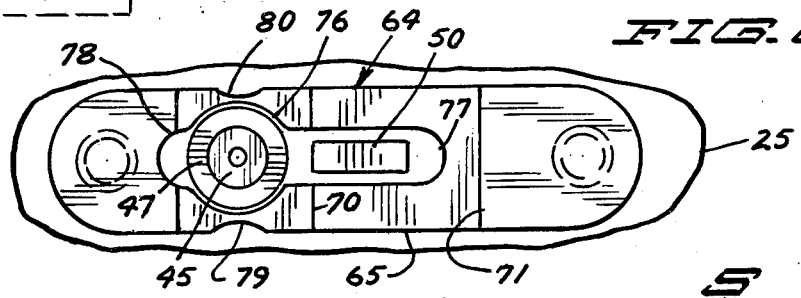
FIG. 6 is an enlarged fragmentary plan view generally taken along the line and in the direction of the arrows 6—6 of FIG. 7 to more fully illustrate the tang pressure pad, tang punches, and guide pin.
Figure 7:
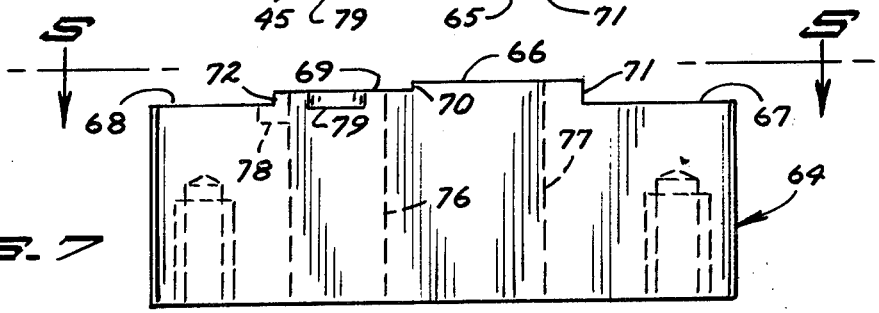
FIG. 7 is an enlarged side view of the pressure pad.

Referring now particularly to FIG. 6 and 7, the tang pressure pad 64 had a longitudinally intermediate, planar top surface 66 and top end surfaces 67 and 68 that are at the same elevation, but at a lower elevation than surface 66. Longitudinally between surfaces 66, 68, there is a vertically intermediate pad surface 69, there being provided a transverse vertical shoulder 70 that extends between surfaces 69 and 66. Each of the surfaces 66 to 69 is substantially planar and horizontal.

Extending vertically through the pressure pad 64 is a circular bore 76 that is substantially longitudinally and transversely centered relative the top surface 69 while a longitudinally elongated slot 77 extends through the pad and radially to circular bore 76, and is of a length to extend a major portion of the distance from shoulder 70 toward the shoulder 71 formed to extend directly between surfaces 66 and 67. The male annular punch 47 extends upwardly into the circular bore 76 while the tang support plate punch 50 extends upwardly in the slot 77 to be generally centrally located relatively the wall defining the slot and substantially spaced therefrom. When the apparatus 10 is in a datum position, the edges 47*b*, 50*a* are located at a lower elevation than surface 69 as is the frusto conical point 56*b*.

On each transverse side of the bore 76, the punch pad 64 is provided with recesses 79 and 80 respectively which are on diametrically opposite sides of bore 76 and extend to a slightly lower relation than surface 69. Further, the pad is provided with a recess 78 that opens upwardly, extends to a slightly lower elevation than surface 68, opens to the central bore 76, and is of a length to extend a short distance more remote from the central aperture than the shoulder 72 that extends between surfaces 68, 69.

Bolted to the stationary die plate 25 to have one vertical longitudinally elongated edge aligned with the corresponding vertically elongated edge 25*a* of the die is an end cutoff block 95. The opposite longitudinal edge of the cutoff block is generally vertically aligned with one edge of the slot 65. Further, the cutoff block 95 is provided with a downwardly opening, longitudinally elongated slot 95*a*, the wall defining the top surface of the slot 95*a* being parallel to the top surface of the die plate 25.

A spacer 83 is mounted on the stationary die plate 25 and has a generally rectangular cutout 84 provided therein that opens to the notch 95*a*. The cutout 84 is located to have the pressure pad 64 moved up thereinto. Mounted on the spacer 83 to extend thereacross is a stripper plate bar 87 which has a circular aperture 88 of substantially the same diameter as aperture 76 and vertically aligned relative thereto (see FIGS. 1, 3 and 4). Further the stripper plate bar has an elongated slot 89 that opens to aperture 88 and in horizontal cross section is substantially the same size and shape as slot 77, and is vertically aligned relative thereto. On the opposite side of the central aperture from slot 89, the stripper plate bar is provided with a slot 90 that extends therethrough and in horizontal cross section is of substantially the same size and shape as recess 78, and vertically aligned relative thereto. The longitudinally intermediate under surface portion of the stripper plate is provided with a downwardly opening groove 92 that extends transversely thereacross. Groove 92 is a longitudinal length and located such that lands 66 and 69 may be extended upward thereinto and land 66 abut against the horizontal surface that in part defines the groove. The depth of groove 92 is greater than the difference in elevation between surfaces 66 and 69. A groove 91 extends transversely across the slide plate and opens to groove 92 such as indicated in FIG. 4. Groove 91 is of a longitudinal dimension that is slightly greater than the diameter of the part of the guide pin 45 above flange 45*a*.

For feeding a web containing tangs to a position to be above punches 47, 50 there is provided a feed assembly, generally designated 105 (see FIGS. 2 and 3). The feed assembly includes a lower feed plate 107 that extends transversely away from the die plate 25 and has an upper planar surface that is substantially co-planar with the top surface of spacer 83, the feed plate being attached to the die plate 25. Bolted to the lower feed plate to extend thereabove is an upper feed plate 111 that has a downwardly opening groove 112 which extends the transverse dimension of the plate 111, opens directly to the groove 92, and is substantially the same longitudinal and vertical dimensions as groove 92 and longitudinally aligned therewith. Further, the upper feed plate is provided with a groove 113 that opens downwardly to groove 112, is of substantially the same vertical and longitudinal dimensions as groove 92, opens directly to groove 91, and is longitudinally aligned therewith.

Rotatably mounted by the end plates 22, 23 to extend therebetween is a feed wheel shaft 110. For each set of feed plates 107, 111 there is provided a feed wheel 109 that is keyed to shaft 110 to rotate therewith. Each feed wheel has a plurality of circumferentially spaced protrusions 109*a* that extend radially outwardly of the feed wheel; the lower feed plate being provided with a slot 108 so that as the feed wheel is rotated the protrusions 109*a* may be rotated through the adjacent portion of groove 113.

Figure 5:
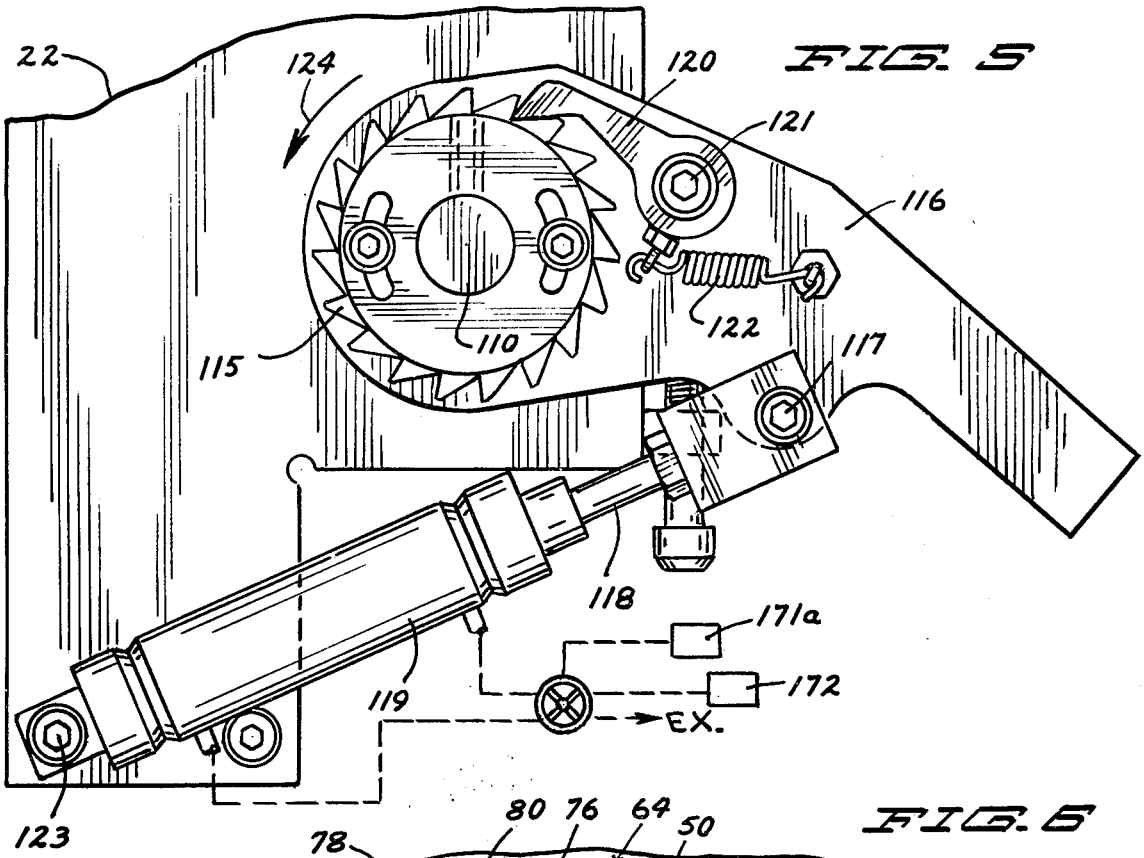
FIG. 5 is a fragmentary end view generally taken along the line and in the direction of the arrows 5—5 of FIG. 2 to illustrate the rachet mechanism.

For selectively rotating indexing shaft 110, a rachet wheel 115 is mounted thereon, while for operating the wheel 115 a rachet lever 116 is pivotally mounted on the shaft adjacent the rachet wheel (see FIG. 5). To pivot the lever first in one direction and then the other direction, a piston rod 118 is pivotally connected at 117 to the rachet lever, piston rod 118 being a part of the piston cylinder combination 118, 119. The cylinder 119 is pivotally connected at 123 to the end plate 22. A pawl 120 is pivotally mounted at 121 to the rachet lever, there being provided a spring 122 that is connected between the pawl and the lever for resiliently retaining the pawl in engagement with the rachet wheel. Thus, as the piston rod 118 is moved to its extended position, the pawl 120 will indexingly rotate the rachet wheel 115 in the direction of the arrow 124; but does not move the wheel when the piston rod is retracted.

For containing a web of tangs, there is provided a reel 127 that is rotatably mounted on a suitable part of the frame for having the web unwound therefrom, it being understood that the position the reel is illustrated in FIG. 3 is merely for convenience and that the web does not make such a sharp bend as it enters into the grooves between the feed plates 107, 111. For cinching a tang punched out the web to a file folder, there is provided cinching apparatus that includes a bar 129 that extends between and is mounted by the end plates 22, 23 in overhanging relationship to the pressure pads. (see FIGS. 1 and 3). Vertically above each guide pin 45, the bar 129 mounts a cinch bolt 130 to extend therebeneath. A nut 131 is threaded on the bolt to aid in vertically adjusting the bolt while a set screw is provided for retaining the bolt in adjusted position relative to the bar. Each bolt is vertically movably downwardly through an aperture **135*a* that is provided in a longitudinally elongated stripper bar 135. Stripper bar 135 is dependingly mounted from the bar 129 by guide bolts 132 which are slidably extended through the bar 129. Nuts are threaded on bolts 132 to limit the vertical downward movement of guide bolts, while springs 133 provided around the guide bolts and bear against the bar 129 and the stripper bar for resiliently urging the stripper bar in a downward direction. Thus the stripper bar is resiliently retained vertically intermediate the bar 129 and stripper plates 87. In its datum position, the cinching bolts 130 have enlarged diametric flanges 130*b* that are of outer diameters greater than the outer diameter of the upper part of the punch 47 and are located above the bottom surface of the stripper bar 135. Extending beneath the flange 130*b* is a cinching point 130*a* which has a maximum diameter at the junction thereof to flange 130*b*, the maximum diameter being less than inner diameter of the punch 47**.

In describing the web, generally designated 128, longitudinal and transverse will be used to refer to the same directions in describing the apparatus 10, considering the web in the position it is fed by the feed mechanism 105. Referring now to FIGS. 8 to 11, the web is made up of an elongated metal strip that is folded and die cut to provide a transversely elongated long leg 136 and a short leg 137 which are joined at the fold line 145. The long leg is longitudinally slit the longitudinal length thereof by plurality transversely spaced slits 138. Between adjacent pairs of slits 138, a long prong 142 is die cut from the long leg, prong 142 at one end being integrally joined to the ring 141 which is also die cut from the long leg except for a part thereof referred to hereinafter. The part of the ring 141 that is diametrically opposite prong 142 is integrally joined to a tab 147 which has an edge integrally joined at fold line 145 to tab 148; tabs 147, 148 being die cut from the long leg and short leg respectively. Tab 148 is integrally joined to ring 140, while the diametrically opposite side of ring 140 is integrally joined to the short prong 139 which extends longitudinally outwardly therefrom and away from the edge **137*b* of the short leg 137 that is opposite fold line 145. As may be noted from FIG. 9, the short leg is of slightly smaller longitudinal and transverse dimensions than the corresponding dimensions of leg 142, while rings 140, 141 are of substantially the same outer peripheral dimensions. The ring 141 is integrally joined to the tang border part 136*a* of the long leg by a pair of small metal strips 144 that are adjacent the tab 147 and on the transverse opposite sides thereof. Ring 140 is integrally joined to the tang border part 137*a* of the short leg by corresponding metal strips 143. The circumferential dimension of each of the strips 144, 143 is only a small fraction of the outer peripheral dimension of the respective side of the ring that extends arcuately between the respective tab to which it is joined. Further, the combination of prongs 139, 142, rings 140, 141, and tabs 147, 148 that form a tang when completely punched from the web strip of metal are only joined to the long and short legs 136, 137 by the two metal strips 141, and the two metal strips 143 respectively. As may be noted from FIGS. 8 and 9 the tang border portions 136*a* extend substantially more remote from the fold line 145 than the tang border portions 173*a* and surround the prongs 142 other than at the juncture of prongs 142 to ring portions 141**.

Figures 2, 9, 10, 11:
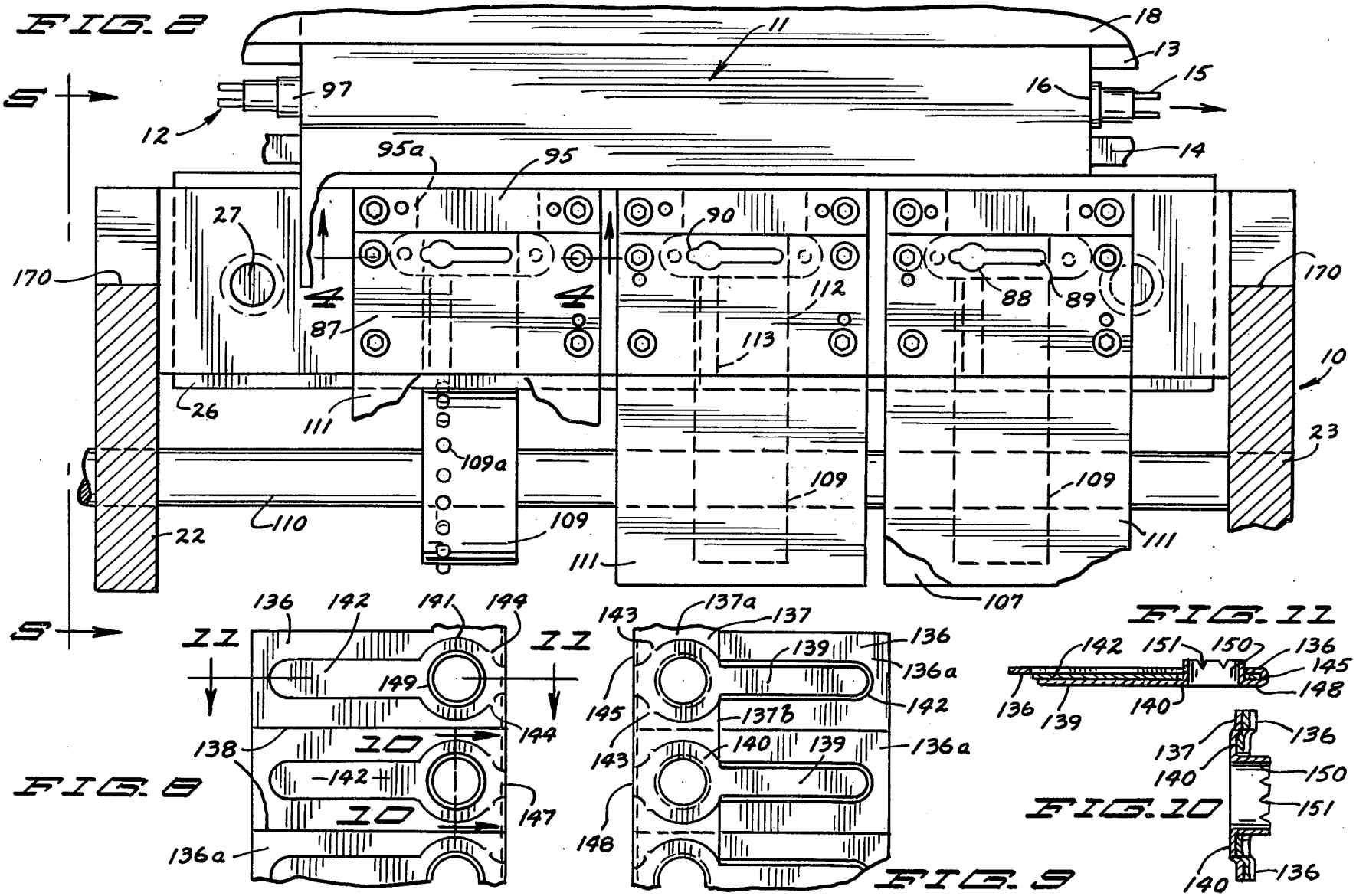
FIG. 9 is a fragmentary bottom view of the web of FIG. 8.
FIG. 10 is a fragmentary cross sectional view generally taken along the line and in the direction of arrows 10—10 of FIG. 8.
FIG. 11 is a fragmentary cross sectional view generally taken along the line and in the direction of arrows 11—11 of FIG. 8.

As may in part be noted from FIG. 10 and 11, the inner periphery of ring 140 has a flange 150 joined thereto to extend vertically upwardly thereof through the aperture 149 of ring 141. Flange 150 is provided with a plurality of circumferentially spaced notches 151 to facilitate cinching the flange to a file folder.

As may be noted in FIg. 11, prong 142 which is die cut from leg 136 is depressed to be approximately coplanar with leg 137 while prong 139, ring 140 and tab 148 are at lower elevations than leg 137 when tang leg 136 is horizontal and is upwardly facing such as indicated in FIG. 11.

Figure 14:
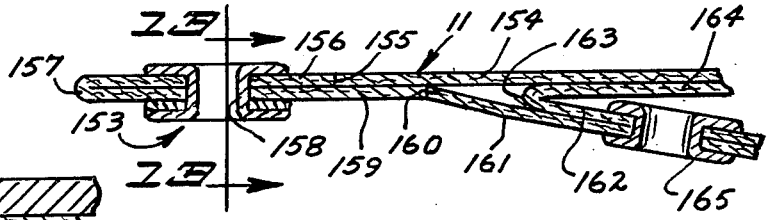
FIG. 14 is a fragmentary transverse cross sectional view of a file folder and a tang cinched thereto.

Referring to FIG. 14, there is illustrated a fragmentary portion of a conventional file folder to a condition that it is moved into the apparatus of this invention to have a tang 153 cinched thereto by said apparatus. The aforementioned file folder includes a front flap 154 that is integrally joined at a fold line 155 to a relatively narrow width strip 156, the opposite edge of strip 156 being integrally joined at fold line 157 to a relatively wide strip 159. The opposite edge of the strip 159 is integrally joined at a fold line 160 to one edge of a relatively narrow strip 161 which in turn at its opposite edge is integrally joined at a fold line (not shown) to a relatively narrow strip 162. The opposite edge of strip 162 is integrally joined at fole line 163 to one edge of back flap 164 that extends beneath the adjacent part of the front flap 154. A plurality of annual rivets 165 are extended through appropriate apertures in strips 161, 162 and cinched thereto when one of strips 161, 162 overlays the other, while a corresponding plurality of apertures are formed in strips 159, 156 to be in overlapping relationship to the annual rivets 165, when flap 161 is in underlying relationship to strip 159 and strip 162 is in underlying relationship to strip 161.

Figure 13:
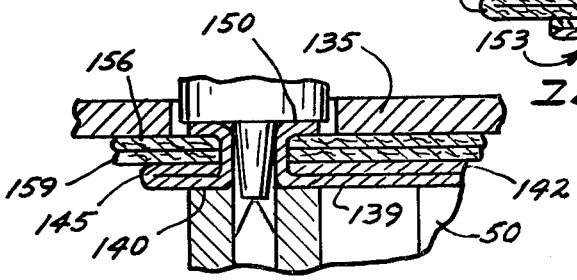
FIG. 13 is a fragmentary longitudinal cross sectional view showing the cinching of a punched out tang to a file folder.

In using the apparatus of this invention, a file folder is carried on the upper runs of endless chains 13, 14, in a folded condition such as in part illustrated in FIG. 13 whereby as the strip portions 156, 159 are moved through the slot 170 in end plate 22, the strip portions will be moved into overlapping relationship to the upper die plate and the apertures 158 in said strips portions will be substantially vertically aligned with the guide pins 45. As the leading edge portion of the folder is moved adjacent to or through slot 170, it interrupts an electric eye beam of the electric eye unit 171 which in turn operates a control 171*a* to apply air from a source of pressurized air 172 to operate the cylinder 119 to extend its piston rod 118. This rotatably indexes shaft 110 for moving the web transversely a distance the same as the spacing between an adjacent pair of slits 138. That is, as the shaft 110 is indexed, one of the protrusion 109*a* on each feed wheel is moved upwardly to extend through the vertically adjacent ring apertures and bear against the rings for moving the respective web toward a pressure pad and thence move outwardly of the ring apertures. As the protrusions moves out of the ring apertures, the shaft 33 is rotated to a position to start moving the lower die shoe 26 vertically upwardly. At this time, the file folder has been moved by the endless chains so that the file folder apertures 158 are substantially vertically above the guide pins 45 and the drive to the endless chains is stopped. The continued upward movement of the lower die shoe results in the frusto conical portions 45*b* of the guide pins 45 moving into the ring apertures whereby the vertically adjacent prongs are centered relative the male punches (moves the web an appropriate amount if the prong is not already properly centered. After the guide pins have been sufficiently moved for centering the prongs, a cam (not shown) on shaft 33 operates appropriate controls to apply air under pressure to the cylinder 53 which results in the guide pins 58 and the pressure pad 64 being moved upwardly to clamp the tang border portions of the webs against the underside of the stripper plates 87. The lower die shoe continues to move upwardly to move the punches 47, 50 above the top surface portions of the pressure pads whereby edges 47*b* abut against rings 140 and edges 50*a* abut against the adjacent part of prongs 139. The continued upward movement of the punches 47, 50 adjacent to and vertically above the lower horizontal surfaces of notches 92 and result in the tangs being completely sheared free from the tang border parts of the webs to which there are joined by strips 143, 144 after the tang border is clamped against the stripper plate bars 87 by the pressure pads.

Additional upward movement of the male punches move the sheared tangs through the apertures 88 and slots 89 to move the vertically extending flanges 150 into and through the apertures 158 of strips 159, 156 for bringing prongs 142 and rings 141 into abutting engagement with the undersides of strips 159. Still further upward movement of the punches moves the flanges 150 into abutting relationship to the cinch bolt points 130*a* which bend the upper parts of the flanges 150 outwardly; and as points 130*a* extend into the flanges, the points abut against guide pins 145 to force them downwardly out of the ring apertures. Continued upward movement of the punches moves the sheared out tang and thereby the folder into abutting relationship with the stripper bar 135 to move the bar upwardly and the flanges 150 into contact with flanges 130*b* to bend the upper parts of flanges 150 radially outwardly to cinch the folder between the reversely folded parts of the flanges 150 and rings 141.

After the tangs have been completely punched out of the tang border portions, air under pressure to the cylinders that forced the piston rods 54 upwardly is discontinued whereby the piston rods return to their datum positions and the pressure pads 64 are free to fall to their datum position. Further, after the punched out tangs are cinched to the file folder, the shaft 33 has rotated sufficiently that the die shoe 26 starts to move downwardly to lower the punches 47, 50. As a result, the stripper bar 135 is resiliently urged downwardly to move the file folder and cinched tangs off of the cinch bolts so that the folder is free to be moved by the endless chains. After the punches 47, 50 have been moved beneath the top surface of the stripper plates 87 the drive to the endless chain is again actuated to move the file folder with the tangs cinched thereto away from the apparatus of this invention and to move another file folder into position to have tangs cinched thereto.

During the time punches 47, 50 were being moved upwardly and the pressure pads were moved upwardly, it moved the tang border portions from which tangs had previously been sheared from upwardly in notch 95*a* to abut against the end cut off blocks 95 to shear the last mentioned tang border portions from the remaining part of the webs.

In setting up for using the apparatus of the invention, the webs are fed into notches 112, 113 such that the flanges 150 extend upwardly into notches 113 and prongs 139 are in abutting relationship to the top surfaces of the lower feed plates 107. In this connection the prongs underlie the part of notches 91 that extend from notches 92 toward the end wall 23.

Prior to starting the operation for cinching tangs to a file folder, each web is manually fed or indexed by wheel 109 to a position that the leading longitudinal edge of the web is fed over spacer 83 to be substantially transversely aligned with the longitudinal edge of the pressure pad that is most closely adjacent the feed wheel. As a result, when the feed wheel is indexed one further step, the leading tang portion is moved into overlaying relationship to the pressure pad whereby the prong 139 is substantially vertically aligned with the slot 77, the ring 143 substantially vertically aligned with aperture 76 and tab 148 in substantially overlaying relationship to recess 78.

Recess 79 is provided to have a portion of a ring 140 that is transversely adjacent the ring vertically above punch 47 extended thereinto whereby the top surface of land 69 can abut against the part of the short leg 137 that is between said rings. Further land 69 is at a lower elevation than land 66 by about the thickness of the short leg whereby the short leg extends over land 69 to terminate at or to the left of shoulder 70 as viewed in FIG. 7. Thus the part of the web above the short leg is pressed against the stripper plate 87 and at the same time land 66 firmly presses the long leg tang border portion that extends more remote from fold line 145 than leg 137 is firmly pressed against the stripper plate 87.

With the present invention, individual tangs do not have to be aligned in a magazine. Further the tangs are retained in pre-selected space relationship from one another by the web until such time as each individual tang is completely separated from the web by the punches 47, 50 that move the tang to the position to be cinched to the folder.

Even though the use of the invention has been described with reference to a particular type file folder, it is to be understood that it can be used for cinching tangs to folders of other constructions or even a single panel or sheet of relatively stiff material. Additionally, by feeding only a single web, one tang may be cinched to each folder. Alternately, the machine may be modified by providing additional feed wheels, feed plates, and other structural elements mounted on members 24–26 and illustrated in FIG. 4 together with additional web reels 127 whereby more than three tangs can be simultaneously cinched to the file folder.

What is claimed is:

1. A transversely elongated web for having tangs mechanically punched therefrom and cinched to a file folder, comprising a transversely elongated first transverse leg having a first edge and an opposite second edge, and a transversely elongated second leg having a first transverse edge integrally joined along a fold line to the first leg first edge, and a second edge generally parallel to the fole line and substantially longitudinally more remote from the fold line than the first leg second edge, the first leg having a plurality of transversely spaced first ring portions and first tab portions extending between the fold line and the first ring portions, and longitudinally elongated first prongs having first edges integrally joined to the first ring portions opposite the first tab portions, and first tang border portions at least partially surrounding the first ring portions, the second leg having a plurality of transversely spaced, longitudinally elongated second prongs having first edges, second ring portions integrally joined to the second prongs first edges, second tab portions integrally joined to the second ring portions opposite the second prongs, and second tang border portions at least partially surrounding the second prongs and second ring portions, the first tab portions being integrally joined to the second tab portions at the fold line, each ring portion having a central opening therethrough, and cinchable flange integrally joined to one ring portion adjacent the edge thereof defining its central opening and relatively narrow width strips for each of one of the legs tang border portions integrally joining the respective tang border portion to at least one of the adjacent tab portion and ring portion.

2. The web of claim 1 further characterized in that there is provided narrow width strips for each of the other legs tang border portions integrally joining the respective tang border portion to at least one of the adjacent tab and ring portions.

3. The web of claim 2 further characterized in that each tang border portion is joined to the ring portion that it partially surrounds by only two of said strips, the diameter of a ring opening being many times greater than the combined arcuate width of said two strips, the prongs and tab portions being separate from the tang border portions.

4. The web of claim 2 further characterized in that each tang border portion is generally planar, and that each ring portion and prong portion that is integrally joined thereto are generally planar and are offset from the plane of the tang border portion that at least partially surrounds the respective ring portion.

5. A transversely elongated web for having tangs punched therefrom and cinched to a file folder, comprising a transversely elongated leg having a first edge and a transversely elongated second leg having a first edge integrally joined along a fold line to the first leg first edge, the first leg having a plurality of transversely spaced, longitudinally elongated first prongs having first edges, first ring portions integrally joined to the first prongs first edges, first tab portions integrally joined to the first ring portions opposite the first prongs, and first tang border portions at least partially surrounding the first ring portions, the second leg having a plurality of transversely spaced, longitudinally extending slits, a second ring portion spaced from and between each adjacent pair of slits, a second tab portion transversely between each adjacent pair of slits and extending between the fold line and the second ring portion that is between the same pair of slits, each second tab portion being integrally joined to the respective second ring portion, a longitudinally elongated second prong for each second ring portion that has a first edge integrally joined to the respective second ring portion opposite the respective second tab portion, and a tang second border portion between each adjacent pair of slits that at least partially surrounds a second ring portion that is between the same pair of slits, the first tab portions being integrally joined to the second tab portions at the fold line, the first tang border portions being integrally joined to the second tang border portions at the fold line, each ring portion having a central opening therethrough, and a cinchable flange integrally joined to each of one of the first and second ring portions adjacent its central opening, and relatively narrow width strips for each of the tang border portions of at least one of the legs integrally joining the respective tang border portion to at least one of the adjacent tab portions and ring portion, each of the tab portions prong and ring portions being joined to the tang border portions only at said narrow strips.

6. The web of claim 5 further characterized in that the longitudinal dimensions of the second leg is greater than the sum of the corresponding dimensions of one of the integrally joined second prong, second ring portion and second tab portion, the slits extending the longitudinal width of the second leg.

7. The web of claim 5 further characterized in that the second tang border portions surround the second prongs other than at the juncture of the second prongs to the second ring portions.

8. A transversely elongated web for having tangs mechanically punched therefrom and cinched to a file folder, comprising a plurality of transversely spaced tangs that each have first and second longitudinally elongated prongs having first edges, first and second ring portions integrally joined to the respective first and second prongs first edges, and first and second tab portions integrally joined to the respective first and second ring portion opposite the first and second prongs respectively, tang border portions at least partially surrounding the first ring portions and extending transversely between adjacent first ring portions, the first tab portions being integrally joined to the second tab portions at a fold line with one of the first and second tab portions overlaying the other, each ring portion having a central opening therethrough, each of one of the first and second ring portions having a cinchable flange joined thereto adjacent the edge defining its central opening, and relatively narrow width strips for each first ring portion to join the first ring portion to the adjacent border portion.

9. The web of claim 8 wherein there is provided a separate second border portion at least partially surrounding each of the second tab, ring and prong portions, and a relatively narrow width strip for each second ring portion to join it to the adjacent second border portion.

10. The web of claim 9 wherein the first and second border portions have integrally joined edges.

11. The web of claim 10 wherein the second border portions, other than at the juncture of the second ring portions to the second prongs, surround the second prongs, the second border portions being of substantially greater longitudinal lengths than the first border portions.

* * * * *